US012649080B1

(12) United States Patent
Small

(10) Patent No.: US 12,649,080 B1
(45) Date of Patent: Jun. 9, 2026

(54) ISOKINETIC AND ISOMETRIC STRENGTH ASSESSMENT, REHABILITATION AND EXERCISE MACHINE

(71) Applicant: Poseidon Strength, LLC, Mechanicsburg, PA (US)

(72) Inventor: Mark Small, Mechanicsburg, PA (US)

(73) Assignee: Poseidon Strength, LLC, Mechanicsburg, PA (US)

( * ) Notice: Subject to any disclaimer, the term of this patent is extended or adjusted under 35 U.S.C. 154(b) by 67 days.

(21) Appl. No.: 18/973,241

(22) Filed: Dec. 9, 2024

(51) Int. Cl.

| | |
|---|---|
| ***A63B 21/002*** | (2006.01) |
| ***A63B 21/00*** | (2006.01) |
| ***A63B 21/008*** | (2006.01) |
| ***A63B 21/062*** | (2006.01) |
| ***A63B 24/00*** | (2006.01) |

(52) U.S. Cl.
CPC ..... *A63B 21/0023* (2013.01); *A63B 21/002* (2013.01); *A63B 21/0083* (2013.01); *A63B 21/062* (2013.01); *A63B 21/4033* (2015.10); *A63B 24/0087* (2013.01); *A63B 21/00069* (2013.01); *A63B 2210/06* (2013.01); *A63B 2220/56* (2013.01)

(58) Field of Classification Search
CPC ..... A63B 21/0023; A63B 21/002; A63B 21/0083; A63B 21/062; A63B 21/4033; A63B 24/0087; A63B 21/00069; A63B 2210/06; A63B 2220/56
See application file for complete search history.

(56) References Cited

U.S. PATENT DOCUMENTS

| | | | | |
|---|---|---|---|---|
| 3,465,592 A | | 9/1969 | Perrine | |
| 3,784,194 A | * | 1/1974 | Perrine | A63B 21/0083 482/112 |
| 4,934,695 A | * | 6/1990 | Wolff | A63B 23/12 482/133 |
| 4,981,199 A | * | 1/1991 | Tsai | F16F 9/20 482/73 |
| 5,005,140 A | | 4/1991 | Havriluk | |
| 5,129,450 A | * | 7/1992 | Hung | A63B 21/00072 482/53 |

(Continued)

FOREIGN PATENT DOCUMENTS

| | | |
|---|---|---|
| CN | 111870902 A | 11/2020 |
| KR | 102084628 B1 | 3/2020 |

(Continued)

OTHER PUBLICATIONS

Speede Gym Products: www. speede.fit.

*Primary Examiner* — Sundhara M Ganesan
(74) *Attorney, Agent, or Firm* — Hilary J. Sumner

(57) ABSTRACT

This exercise machine offers isometric and isokinetic exercise by regulating the speed of fluid flowing through the machine's hydraulic system. The consistent speed of the moveable elements on the machine prevents injury and enhances strength training of the targeted muscle groups by maintaining constant strain on those muscles throughout the exercise. This method incorporates both a PTCFC valve and a check valve device to compensates for both pressure and temperature variations within the hydraulic system over time. Additional machine elements allow for analysis of the user's strength through data and graphical displays.

8 Claims, 10 Drawing Sheets

(56) References Cited

U.S. PATENT DOCUMENTS 5,314,390 A * 5/1994 Westing ..... A63B 21/4034 601/36
5,362,298 A * 11/1994 Brown ..... A63B 24/0062 601/40
5,505,281 A * 4/1996 Lee ..... A63B 21/00072 188/322.15
5,622,527 A * 4/1997 Watterson ..... A63B 22/0056 482/53
7,575,538 B1 * 8/2009 Clark ..... A63B 23/0355 482/142
7,846,067 B2 * 12/2010 Hanoun ..... A63B 21/008 482/901
10,857,404 B2 12/2020 Small
12,397,200 B2 * 8/2025 Small ..... A63B 24/0087
2002/0072452 A1 * 6/2002 Torkelson ..... A63B 24/00 482/51
2002/0091038 A1 7/2002 Johnston et al.
2005/0049122 A1 3/2005 Vallone et al.
2005/0209061 A1 * 9/2005 Crawford ..... A63B 22/0292 482/8
2010/0216600 A1 * 8/2010 Noffsinger ..... A63B 23/12 482/5
2013/0165825 A1 6/2013 Carrillolopez et al.
2016/0016033 A1 * 1/2016 Schrag ..... A63B 22/0048 482/129
2016/0144239 A1 5/2016 Sclafani et al.
2016/0354638 A1 * 12/2016 Carr ..... A63B 21/4043
2020/0139187 A1 * 5/2020 Kennington ..... A63B 71/0622
2021/0023416 A1 1/2021 Yu et al.
2023/0110120 A1 4/2023 Small

FOREIGN PATENT DOCUMENTS

WO WO 2002043815 A1 6/2002
WO WO 2021032848 A1 2/2021

* cited by examiner

ISOKINETIC AND ISOMETRIC STRENGTH ASSESSMENT, REHABILITATION AND EXERCISE MACHINE

CROSS REFERENCE TO RELATED APPLICATIONS

Not Applicable

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

BACKGROUND OF THE INVENTION

Resistance training offers an effective means for developing strength and building muscle tissue. The efficacy of any exercise is governed by the resistance applied to the body. There are three main categories of strength training: isometrics, isotonics, and isokinetics.

In isometric exercise, such as maintaining a plank position or holding a weight in a place, there is no movement involved. Isometric exercises are performed in a static position and are therefore very beneficial for rehabilitation and improvement of overall strength.

In isotonic exercises such as weightlifting, squats, or push-ups, the athlete's muscles move through two phases; (1) the concentric phase where the length of the muscle shortens and (2) the eccentric phase where that same muscle lengthens. In an isotonic bicep curl, the affected muscle group shortens as the weight is lifted. The same muscle group lengthens as the weight is lowered. Isotonic exercises are very effective in building muscle strength, endurance, and overall fitness; however, they may be harmful when equipment is overloaded or used in an improper way.

Isotonic exercise machines traditionally require the user to move a fixed resistance or weight through a particular range of motion (ROM). One of the main drawbacks of standard isotonic equipment is the limited preset weight or resistance settings. Athletes are typically forced to select weight at five pound intervals, opting for a load in which they are prepared to fail. Overly optimistic load selection or improper form can lead to muscle damage, joint stress, and muscle imbalance.

Additionally, free weights and standard isotonic fitness equipment do not address the inherent problem of varying torque throughout the ROM based on the nature of the ROM and the anatomical variation of the individuals performing the exercise. Because the resistance varies throughout the routine, the athlete may struggle to maintain a safe form under increased torque. Release of the load may lead to injury in an emergency. This becomes even more critical when the machine is being used in rehabilitation for those who are recovering and rebuilding muscle.

Isokinetics is a strength training method that blends the intense muscular contractions of static isometric exercise with the full ROM required in isotonic workouts. True isokinetic machines require each targeted muscle group to work against an adaptive user-generated resistance that maintains a constant velocity/speed throughout the entire ROM. This provides variable resistance, opposing the athlete's strength throughout the entire ROM to provide maximum muscle engagement without risk of overexertion. This can be particularly useful in rehabilitation from an injury as it allows patients to build strength safely while minimizing stress to the affected joints and muscles.

Isokinetic exercise also aids in developing balanced strength between opposing muscle groups, creating holistic strength and reducing the risk of future injury. This type of exercise lends itself to more accurate tracking of progress both for athletes in training and those recovering from trauma.

Muscle strength and balance is generally measured through manual muscle testing, functional movement evaluations, 1-repetition maximum (1RM) testing, resistance band assessments, handheld dynamometry, or force plates. Manual muscle and functional movement analysis is subjective and imprecise as the therapist alone assesses improvement through observation and manual feedback. Handheld dynamometry requires special training and may be inexact if the device is not properly positioned. This equipment is also incapable of recording high forces. Resistance band testing can be difficult to quantify into precise strength levels while 1RM testing may subject patients to injury.

Force plates provide the most accurate means of assessing strength and muscle balance; however, they are costly and require constant calibration for accurate measurement. Variations in the user's patterns of movement can lead to inaccurate results and specialized training is required to interpret data delivered from the device. Force plates are best adapted to measure vertical ground reaction forces; they are not well suited to measure horizontal forces or rotational movements.

The variable nature of isokinetic strength training makes it the optimal exercise for any fitness level, creating balanced strength between opposing muscle groups and reducing the risk of injury. A properly designed isokinetic exercise machine would allow world-class athletes and paraplegics alike to quantify improvement in fitness levels and assess strength in targeted muscle groups without specialized training.

Neither free weights nor standard friction, pneumatic, or hydraulic resistance mechanisms deliver the spontaneously adaptive user-generated resistance required for isokinetic exercise. There is therefore a need in the art for an exercise machine that addresses variation in anatomy, provides consistent speed and instantaneously adaptive user-generated resistance, as well as refined resistance adjustment for safe and effective strength training and assessment.

BRIEF SUMMARY OF THE INVENTION

As previously noted, anatomical variation and changing loads throughout a standard workout lead to overdevelopment of some muscle groups and underdevelopment of others. Those who set the equipment at a high resistance may sustain injury at points within the ROM due to excessive torque on the moving body part(s). Similarly, users making explosive movements may overwhelm the friction, pneumatic, or hydraulic limiters within their chosen equipment and may hurt themselves or may fail to maintain proper form during their workout.

The present invention provides a means for achieving a reliable isokinetic workout, offering dead lift, squat, bench press, and latissimus dorsi (lat) exercises and others, in one unit. This invention additionally offers unilateral strength assessments of muscle groups such as the hamstring, quadriceps, and calf complex muscle groups as well as the Achilles tendon and a multitude of other muscle groups. In this design, a specialized hydraulic system, capable of accommodating changes in both fluid pressure and temperature, is connected to a moveable sheave block and carriage through a set of pulleys and wire ropes.

This novel hydraulic system and pulley configuration allows the exerciser to maintain a constant velocity of movement through the entire ROM of their selected exercise and additionally captures the maximal strength output through that ROM. The user will not be able to overcome the machine resistance through explosive and potentially harmful movements; the machine moves at a constant speed regardless of the force that is applied. Additionally, the present invention ensures that no detectable energy is stored within the system. The user can let go of the exercise arm at any time and the arm will maintain its position. This reduces the risk of damage to the equipment and injury to the user when the exercise arm is released.

REFERENCE NUMERALS

Figure 1:
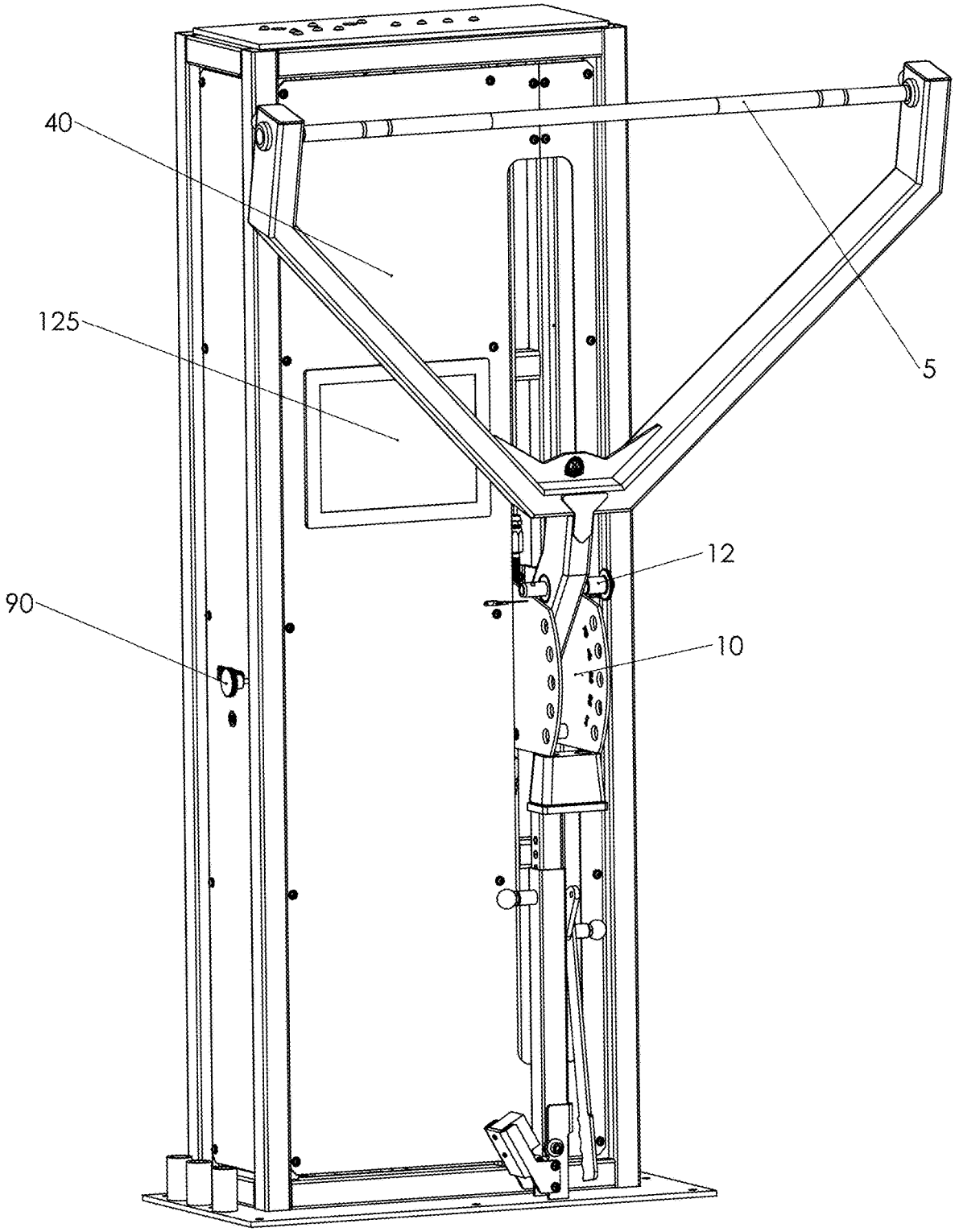
FIG. 1 is a left side perspective view of an isokinetic/isometric assessment and exercise machine cabinet having a display screen.

5 Exercise handle/Exercise Handle/User Driven Element
10 Carriage
11 Hinge Point
12 Pivotal Placement Mechanism
15 Closed Loop Hydraulic System
20 Tensioning Pulley Set
25 Fixed Pulley
30 Moveable Sheave Block
35 Linear Bearing Rail
40 Cabinet
45 First Wire Rope
50 Counterweight
55 Second Wire Rope
60 Third Wire Rope
65 Fourth Wire Rope
70 Tensioning Device
72 Rod
75 Piston
78 Cylinder
80 Fluid Flow
85 Pressure and Temperature Compensating Flow Control (PTCFC) Valve
90 Speed/Flow Adjustment Mechanism
95 PTCFC Valve Inlet
100 PTCFC Valve Outlet
101 Flow Rate Orifice Needle
102 Flow Rate Adjustment Orifice
103 Pressure Compensating Spool
104 Temperature Compensating Spool and Element
105 Reverse Flow Check Device
106 Check Valve Spring
107 Variable Pressure Compensating Orifice
108 Temperature Compensating Flow Orifice
109 Pressure Compensating Spool Spring
110 Pressure Compensating Spool Chamber
111 Pressure Adjustment Chamber
115 Head Tank
120 Bleed Valve
125 Display/Touch Screen
130 Pressure Transducer
135 Data Connection (from Pressure Transducer to DAQ)
145 Carriage Support Stop

DETAILED DESCRIPTION OF THE INVENTION

In this patent application, the moveable portion of the exercise machine defining the ROM of a particular movement shall be referred to as a "user driven element," "exercise arm," or "handle" 5. It should be noted that more than one user driven element or exercise arm may exist on any given piece of exercise equipment. While inventor envisages the use of oil in the closed loop hydraulic system, the term "fluid," as used in this application, shall mean any incompressible liquid. For this purpose of this application, the phrase "wire rope" shall refer to rope, cable, wire, and other lengths of material commonly threaded about pulleys and capable of withstanding forces standard to exercise equipment. The phrase "mechanically fastened" or "mechanically affixed" shall refer to any standard fastening method including but not limited to screws, nuts, bolts, threaded rods, adhesives and the like and shall further include parts that are integral to one another.

Hydraulic systems are common in exercise equipment; however, the standard components used in a common hydraulic system allow the user to increase speed of the fluid within that system by applying additional force to the equipment. Changes in fluid viscosity further compound this problem. The fluid within standard hydraulic systems increases in temperature as the equipment is used due to friction, lowering the viscosity of the fluid and creating increased fluid flow even with constant user force. These variations in fluid speed may occur within the hydraulic system even where a pressure compensating valve is used. This change in viscosity prevents in the user from achieving a true isokinetic workout.

The present invention is comprised of a moveable carriage 10 in mechanical communication with a closed loop hydraulic system 15 via a series of pulleys 20/25 and moveable sheave block 30. This hydraulic system 15 not only adjusts for fluid pressure changes but also for temperature variations in that fluid over time, thereby metering the speed of fluid 80 and the subsequent speed of the exercise handle 5.

Figure 2:
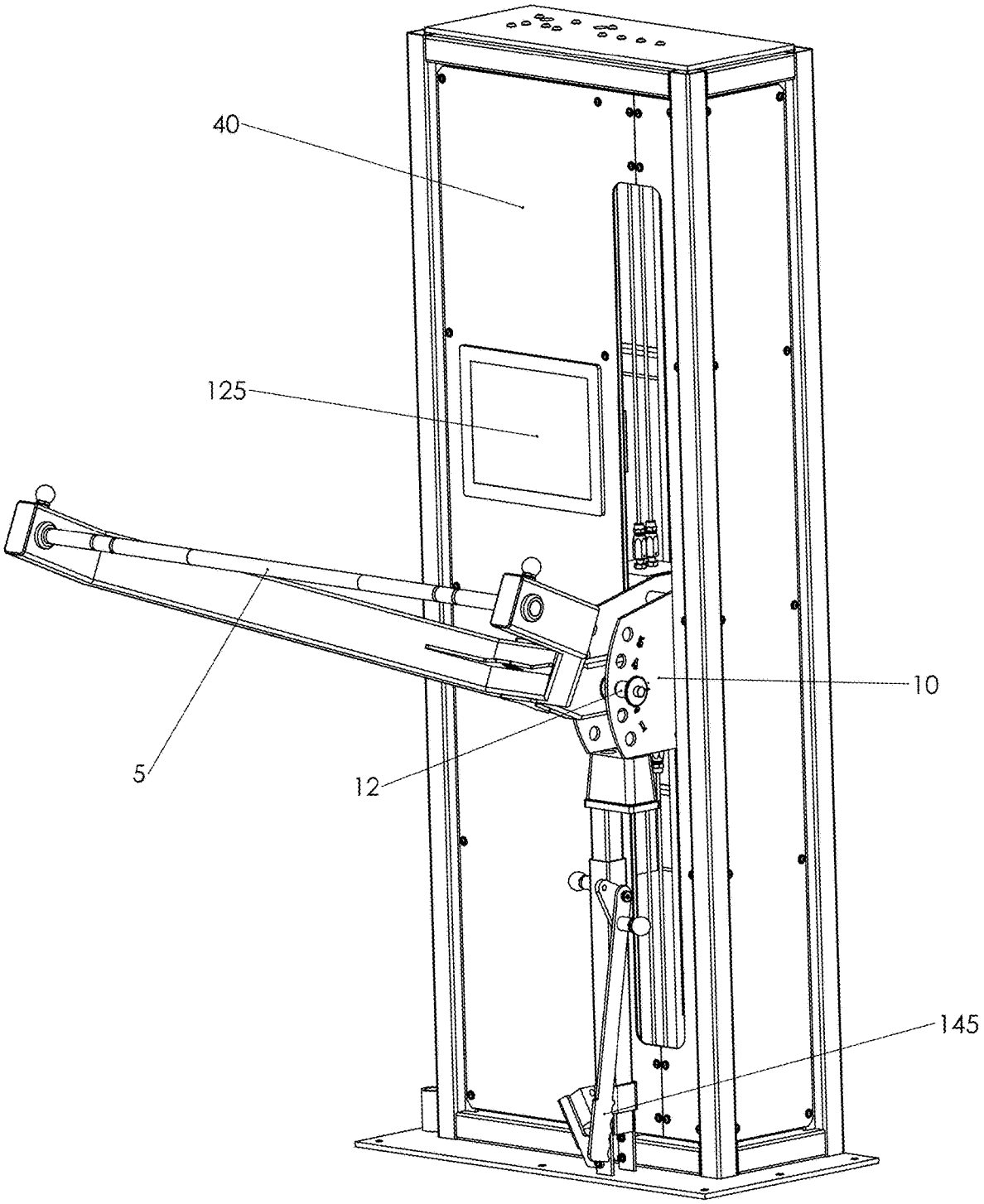
FIG. 2 is a right side perspective view of an isokinetic/isometric assessment and exercise machine cabinet having a display screen.
Figure 3:
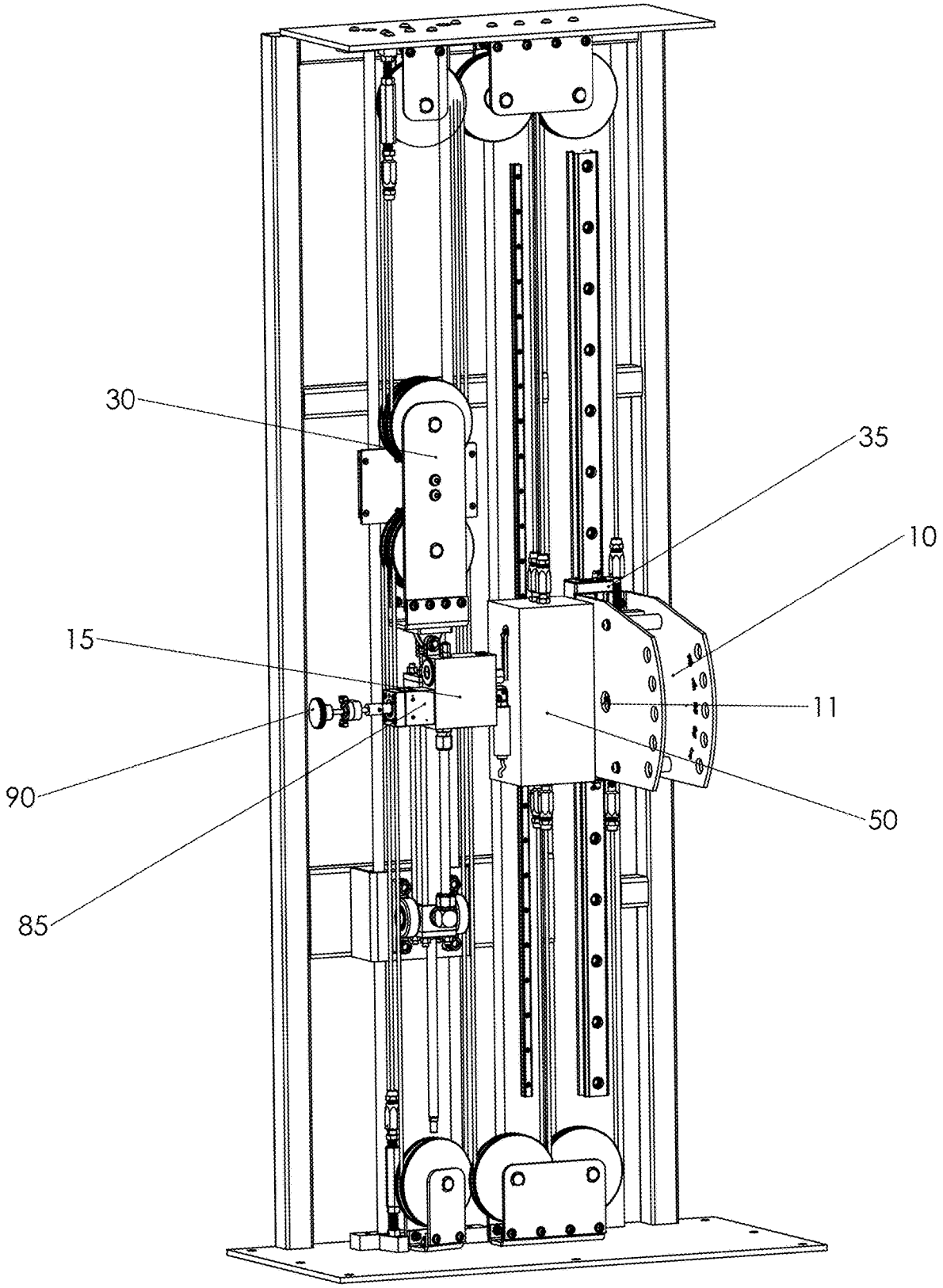
FIG. 3 is a left side perspective view of the internal mechanism of an isokinetic/isometric assessment and exercise machine.

Referring now to FIGS. 1-4, the present invention is comprised of a carriage 10 mechanically affixed to a linear bearing rail 35 and mounted within or on a free standing housing, tower, or wall (hereinafter collectively referred to as a "cabinet") 40. An exercise arm or handle 5 is mechanically affixed or connected to the carriage 10. FIGS. 1-3 depict one embodiment where the handle 5 is pivotally mounted to the carriage 10 via a hinge point 11 and pivotal placement mechanism 12. This configuration allows the user to select a desired handle height or angle by placing the pivotal placement mechanism 12 in the corresponding cavity within the carriage 10. The hinge point 11 and pivotal placement mechanism 12 also allow the handle 5 to be folded and stored in a relatively flat position against the cabinet 40 as illustrated in FIG. 1.

Figure 5:
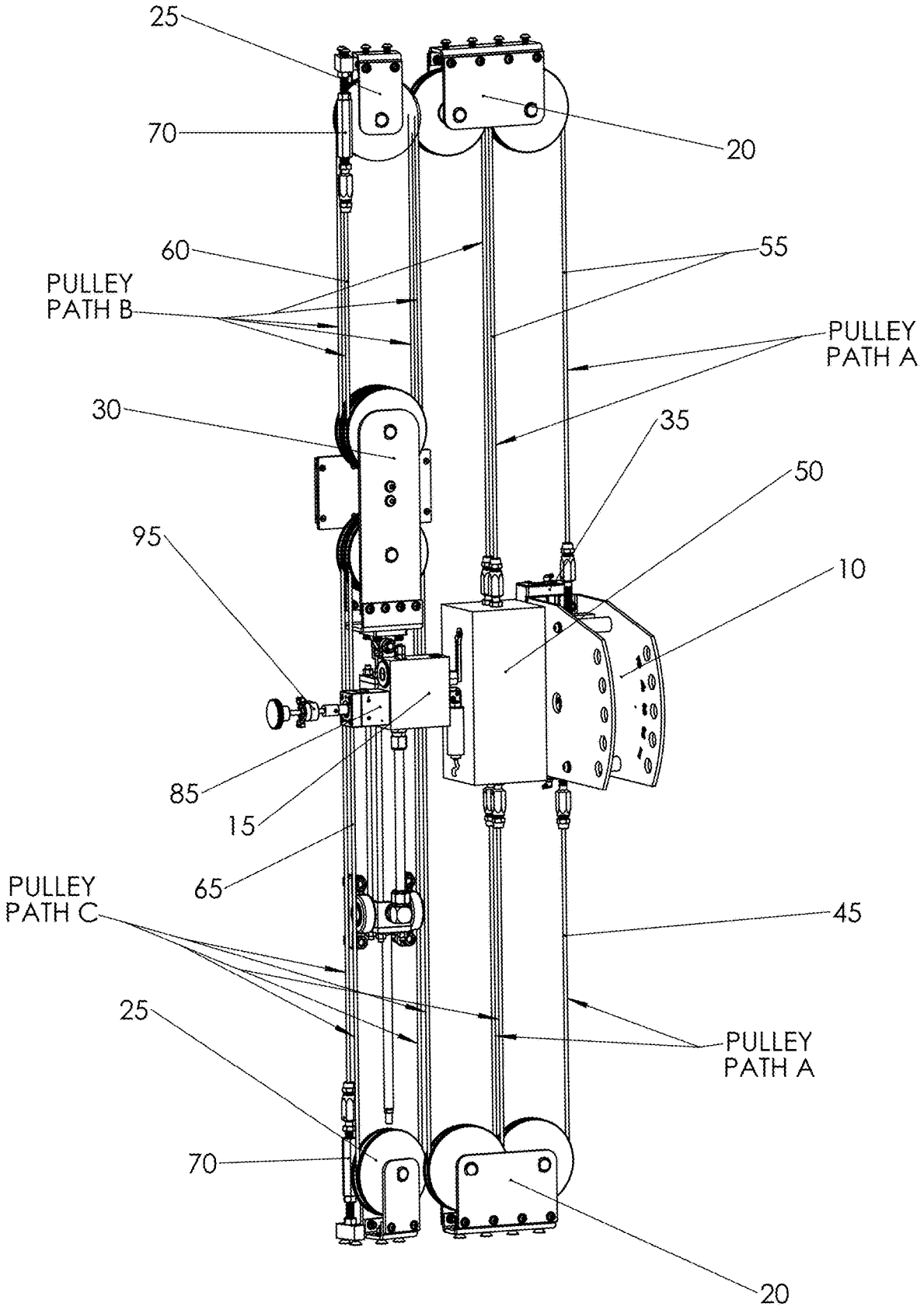
FIG. 5 is a left side perspective view of one embodiment of the pulley configuration in the isokinetic/isometric assessment and exercise machine.

FIG. 5 depicts one embodiment of the invention where one end of a first wire rope 45 is mechanically fastened to the carriage 10. The free (or second) end of the first wire rope 45 is threaded about a first set of tensioning pulleys 20, and mechanically affixed to a counterweight 50 as described more fully below. One end of a second wire rope 55 is similarly mechanically fastened to the carriage 10. The free (or second) end of the second wire rope 55 is threaded about a second set of tensioning pulleys 20 and mechanically affixed to the counterweight 50 as shown in FIG. 5. Wire ropes 45 and 55 work in concert to create "Pulley Path A." It should be noted that one continuous single wire rope may be used to create Pulley Path A (in lieu of individual wire ropes 45 and 55) if said single wire rope travels through the carriage 10 and counterweight 50.

Figure 4:
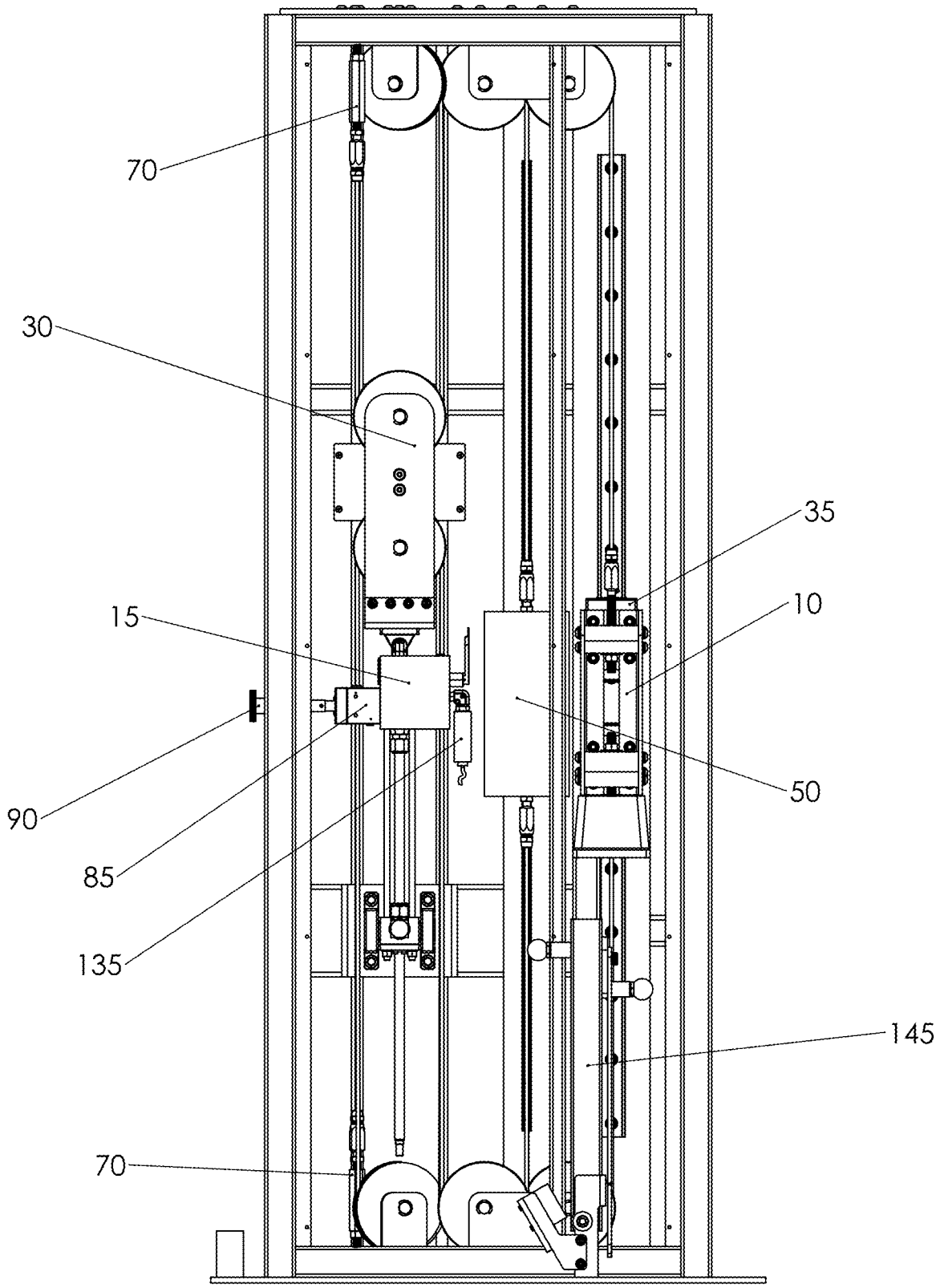
FIG. 4 is a front planar view of the internal mechanism of an isokinetic/isometric assessment and exercise machine.

One end of a third wire rope 60 mechanically affixed to the counterweight 50 and threaded about the second set of tensioning pulleys, through the upper portion of the moveable sheave block 30, and through a fixed pulley 25 positioned near the top of the machine. The second (or free end) of the third wire rope 60 is mechanically affixed to the cabinet 40. The path of the third wire rope 60 creates "Pulley Path B". One end of a fourth wire rope 65 is mechanically affixed to the counterweight 50, it is threaded about the first set of tensioning pulleys 20, then threaded about the lower portion of the moveable sheave block 30 and is finally threaded about a fixed pulley 25 positioned near the base of the machine. The second (or free end) of the fourth wire rope 65 is mechanically affixed to the cabinet 40. The path of the fourth wire rope 65 creates "Pulley Path C". In the described embodiment, the fixed pulleys 25 and tensioning pulley sets 20 are arranged in a mirror-image configuration; however, it should be understood that the pulley configuration may be arranged in any fashion that results in the required tension for Pulley Paths A-C. Tensioning within each path may be modified via a tensioning device 70 such as a coupling nut connected to right and left threaded rods as depicted in FIGS. 4 and 5. While four wire ropes and six pulleys are employed in the embodiment shown in FIGS. 3-5 it should be understood that fewer wire ropes and pulleys may be used. A design having one wire rope connecting the counterweight 50 to the carriage 10 and having at least one wire rope connecting the moveable sheave block 30 to the counterweight 50 and cabinet 40 may be used provided that the pulley and wire rope configuration achieves the proper tensioning between the components.

Figure 7:
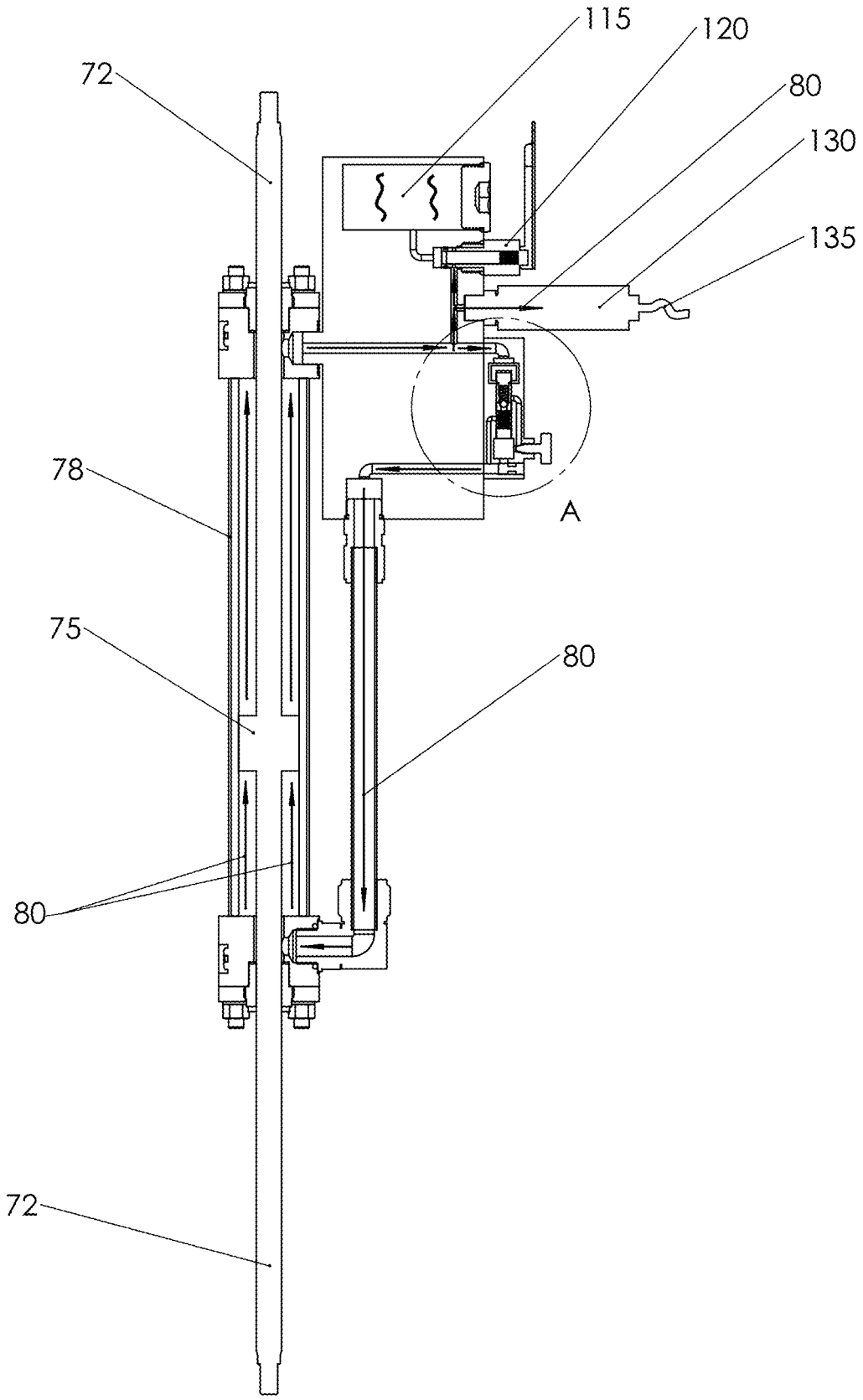
FIG. 7 is a cross-sectional view of the elements shown in FIG. 6 showing fluid flow in a forward stroke.
Figure 8:
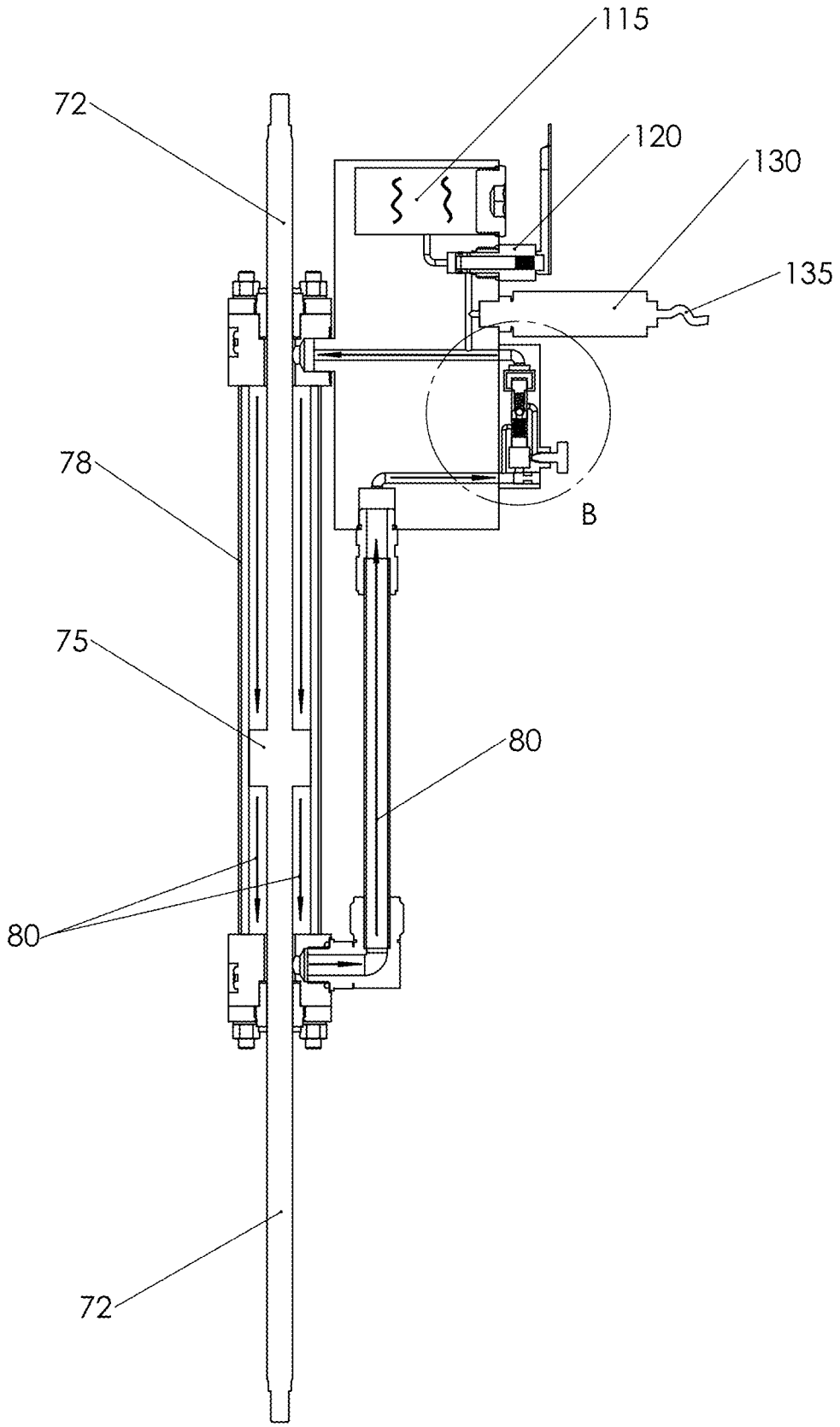
FIG. 8 is a cross-sectional view of the elements shown in FIG. 6 showing fluid flow in a reverse stroke.

Referring to FIGS. 4-5, the moveable sheave block 30 is mechanically affixed to a closed loop hydraulic system 15, via a rod 72, such that fluid 80 flows within the system 15 as the sheave block 30 moves. A piston 75 integral to the rod 72, as depicted in FIGS. 7 and 8, facilitates the fluid flow 80 within the hydraulic system 15. A pressure and temperature compensating flow control valve 85 within the closed loop hydraulic system 15 (hereinafter referred to as the "PTCFC valve") controls and regulates the velocity of the fluid 80 regardless of pressure or temperature changes within that hydraulic system 15. The PTCFC valve 85 is described more fully below and includes a speed adjustment mechanism 90.

Figure 6:
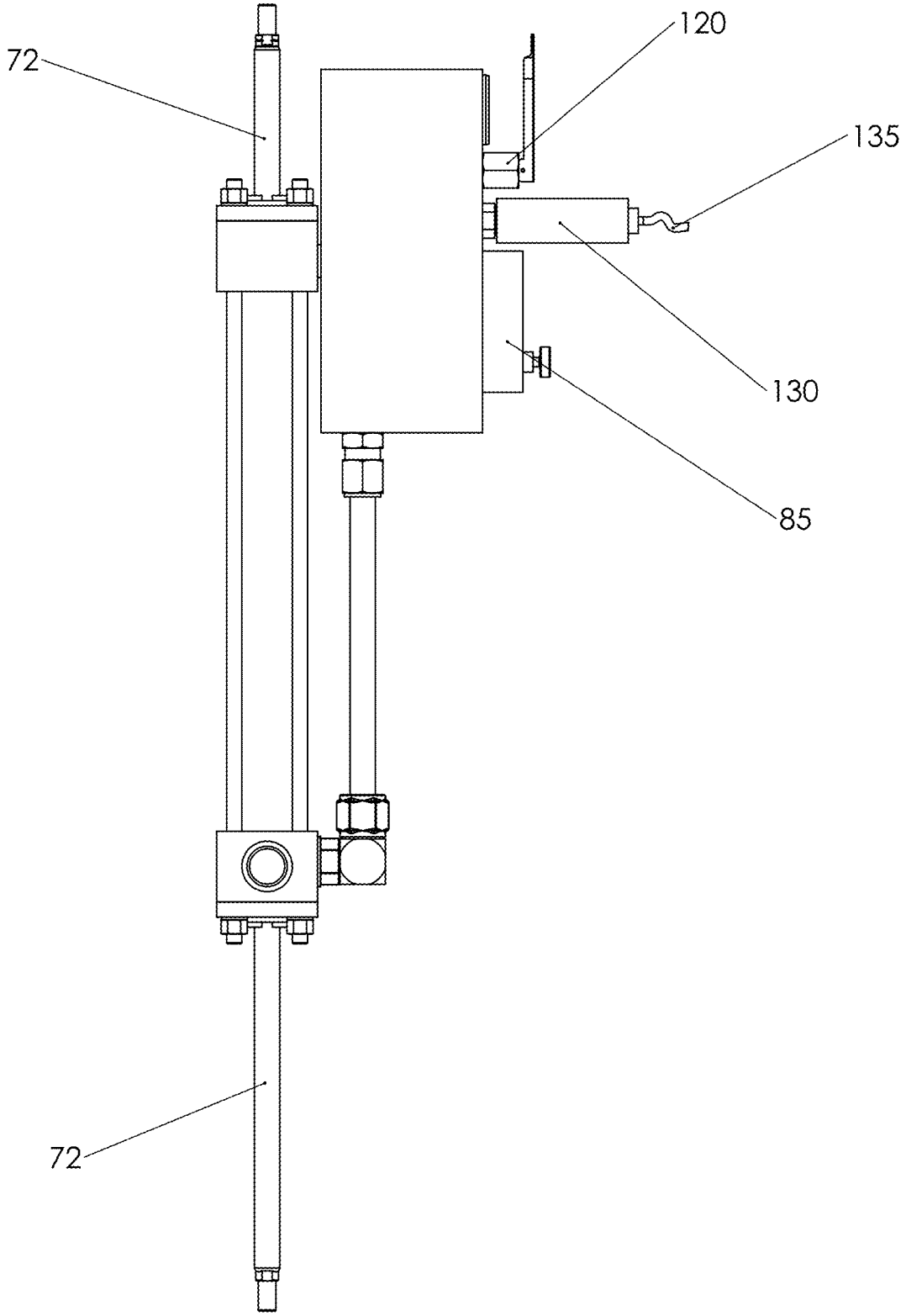
FIG. 6 is a front planar view of the closed loop hydraulic system, piston, cylinder, PTCFC valve and data connection.

Ideally, the closed loop hydraulic system 15 is comprised of a two port cylinder 78 as shown in FIGS. 7 and 8; alternatively, a one port cylinder 78 having a breather valve or similar component allowing movement of the piston 75 within the cylinder 78 may be used. The closed loop hydraulic system 15 is designed such that there are no pockets of free air within that system. A head tank 115 and bleed valve 120 may be added to facilitate bleeding of air from the system 15 as illustrated in FIGS. 6-8.

Figure 9:
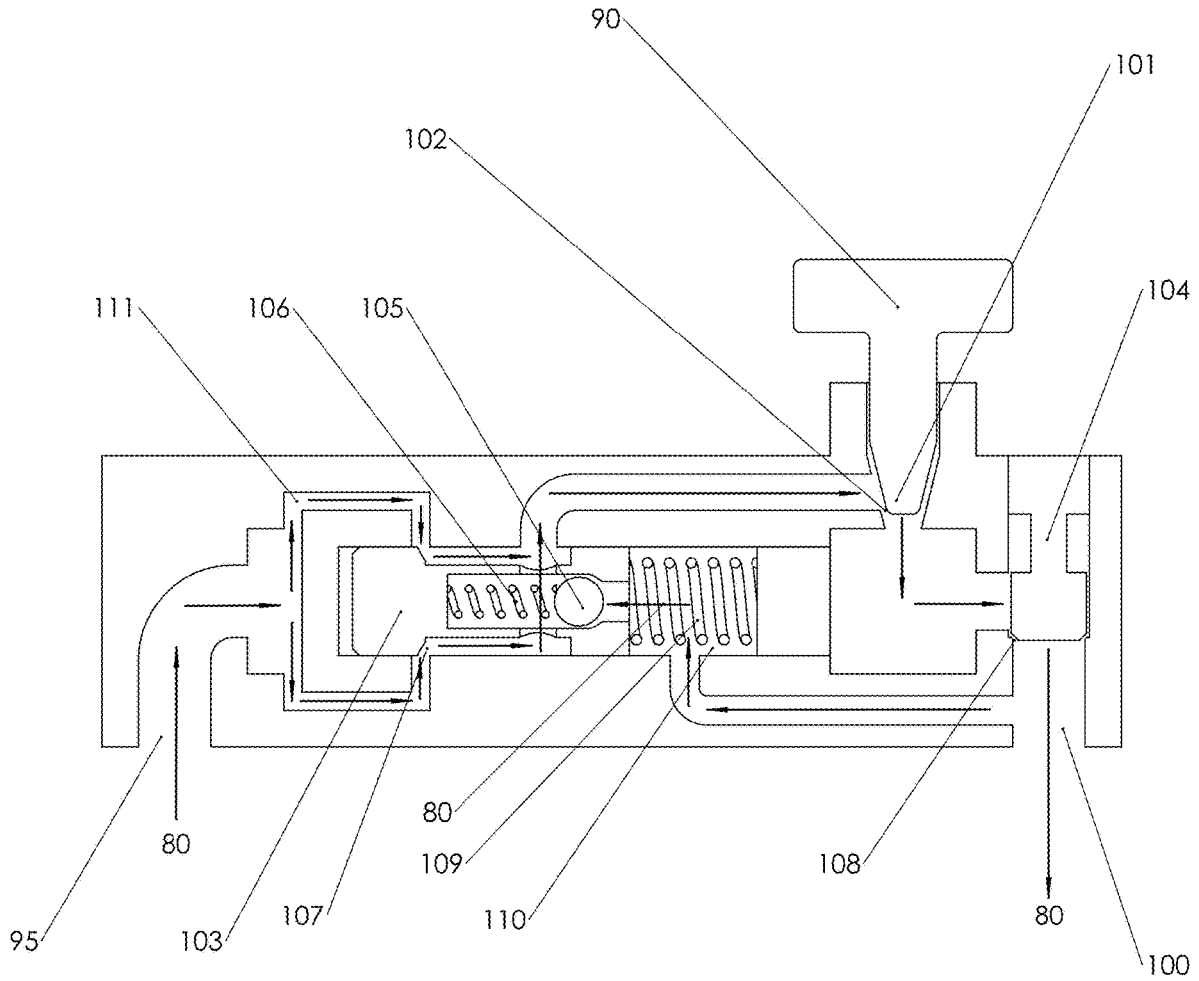
FIG. 9 is an enlarged cross-sectional view of callout A shown in FIG. 7 illustrating the fluid flow in the PTCFC valve in a forward stroke.

It should be recognized that the valve industry commonly markets valves offering "constant" fluid flow; however, the variable nature of these hydraulic systems results in fluid flow that is "measurably inconstant" and physically discernable by the user. For the purposes of this application "substantially constant fluid flow" is defined such that changes of the fluid flow within the present invention are physically undetectable by the individual using the system. With this in mind, the fluid flow 80 and subsequent difficulty level of the workout will remain substantially constant in the forward exercise stroke (as depicted in FIGS. 7 and 9) regardless of the force the user applies to the exercise handle 5. In other words, the exercise handle 5 cannot be moved any faster than the selected flow rate within the system will allow during a forward exercise stroke no matter how much force or torque is applied. By creating substantially constant fluid flow in the forward exercise stroke, the machine taxes both primary and secondary muscle groups evenly throughout the ROM of the exercise. Movement of the piston 75 throughout the forward stroke causes fluid 80 to flow into the cylinder 78, thereby pushing fluid 80 into the PTCFC valve 85 during each forward stroke cycle.

Before beginning a workout, the user selects a desired machine speed (fluid flow rate) through the speed adjustment mechanism 90 which can be modified manually via a knob or electronically adjusted through a motor electrically connected to a touch screen 125 or similar device. As the user pulls on the exercise handle 5, the wire ropes (45/55/60/65) move within their respective pulley paths, causing the moveable sheave block 30 to change position, thereby advancing or retracting the rod 72 connected to the moveable sheave block 30 as shown in FIGS. 3-5. In the embodiment shown in FIGS. 4-5, upward movement of the moveable sheave block 30 creates a forward exercise stroke flow. In a "forward stroke", the piston 75 advances within the hydraulic cylinder 78 in an upward motion, initiating flow of fluid 80 within the closed hydraulic system in a forward direction.

During the return stroke, movement of the handle 5 results in the motion of the moveable sheave block 30 and rod 72 connected to it. This causes the piston 75 to retract within the cylinder 78 in a downward motion as shown in FIG. 8, reversing the flow of fluid 80 within the system 15. It should be understood that the directional terms used herein are employed to assist in the explanation of fluid flow and that the specific direction of the fluid flow will depend on the position of applicable components within the device.

Pressure and temperature flow regulating and compensating devices within the PTCFC valve 85 ensure that the fluid flow 80 remains substantially constant regardless of any fluctuations of pressure or temperature within the hydraulic system 15 during a forward exercise stroke. This is accomplished through changes in internal orifice sizing and component positions within the PTCFC valve 85 as described more particularly below.

Figure 10:
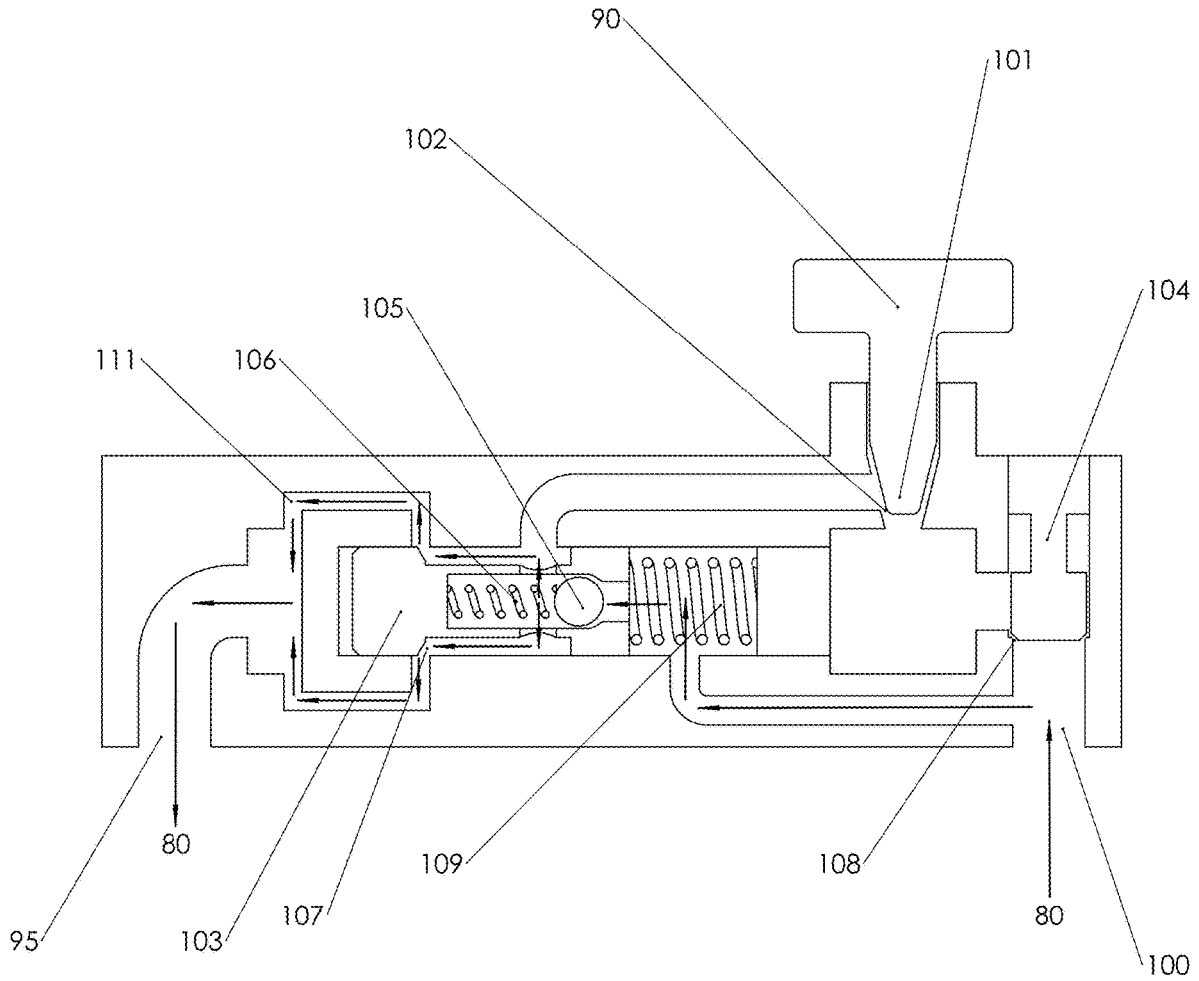
FIG. 10 is an enlarged cross-sectional view of callout B shown in FIG. 8 illustrating the fluid flow in the PTCFC valve in a reverse stroke.

Referring to FIGS. 9 and 10, a standard PTCFC valve is comprised of a speed/flow adjustment mechanism 90, a PTCFC valve inlet 95, a PTCFC valve outlet 100, a flow rate orifice needle 101 seated within a flow rate adjustment orifice 102, a pressure compensating device, a temperature compensating device and a reverse flow check valve. The speed/flow adjustment mechanism 90 determines the length of the flow rate orifice needle 101 that extends into the flow rate adjustment orifice 102, this needle depth sets the system pressure drop across the flow rate adjustment orifice 102 to control the flow rate. The pressure compensating device is comprised of a pressure compensating spool 103, a variable pressure compensating orifice 107, a pressure adjustment chamber 111, and a pressure compensating spool spring 109, and a pressure compensating spool chamber 110. The temperature compensating device is comprised of a temperature compensating spool and element 104 and a temperature compensating flow orifice 108.

Referring now to the arrows depicting fluid movement in FIG. 9 during a "forward stroke," fluid 80 flows through the PTCFC valve inlet 95 and into the pressure adjustment chamber 111, continuing through the variable pressure compensating orifice 107, flowing beyond the pressure compensating spool 103, out through the flow rate adjustment orifice 102, into the temperature compensating flow orifice 108 and through the outlet 100. The pressure compensating spool 103 is attached to a pressure compensating spool spring 109 and an integral reverse flow check valve comprised of a reverse flow check device 105 and a check valve spring 106 as shown in FIGS. 9 and 10. It should be understood that a check valve may be installed parallel to the PTCFC valve 85 if the PTCFC valve does not have an integral reverse flow check valve. The pressure compensating spool spring 109 compensates for the pressure differential between the flow rate adjustment orifice 102 and the PTCFC valve outlet 100. Pressure at the PTCFC valve outlet 100 is transferred to the pressure compensating spool chamber 110, causing the pressure compensating spool 109 to either advance or retract within this chamber 110, moving the pressure compensating spool 103 to maintain a constant fluid flow rate regardless of pressure changes. Incoming fluid 80 at the inlet 95 pushes the pressure compensating spool 103 forward until resistance from the pressure compensating spool spring 109 prevents further movement of the pressure compensating spool 103. The position of the pressure compensating spool 103 determines the volume of fluid that flows within the pressure adjustment chamber 111, regulating fluid flow to the flow rate adjustment orifice 102 and thereby regulating the speed of the handle 5. As noted above, the PTCFC valve 85 compensates for temperature and subsequent fluid viscosity variations through the use of a temperature compensating spool and a temperature sensitive element such as a bimetallic strip that reacts to temperature changes within the fluid by expanding or contracting. This expansion or contraction decreases or increases the size of the temperature compensating flow orifice 108, thereby maintaining constant speed and fluid flow within the system regardless of the fluid viscosity. The temperature compensating spool and element are identified as 104 in FIGS. 9 and 10.

Referring now to FIG. 10, fluid 80 in the "return stroke" enters the PTCFC valve 85 through the outlet 100. Because pressure at the outlet 100 is greater than that at the inlet 95, this pressure overcomes the check valve spring 106 allowing the reverse flow check device 105 to move and permitting fluid 80 to bypass the temperature compensating flow orifice 108. Fluid 80 within the flow rate adjustment orifice 102 causes the pressure compensating spool 103 to retract allowing fluid 80 to flow relatively unrestricted through the PTCFC valve 85.

Referring once again to FIGS. 4 and 5, the counterweight 50 has a mass that approximates the mass of the carriage 10 and exercise handle 5, offsetting the energy within the system 15. If the user lets go of the handle 5, that handle will remain substantially in the same position. This counterweight 50 prevents the user from being injured when the handle 5 is dropped and has proven particularly useful in therapeutic exercise where the user's strength may be compromised. If the user applies a slight force to the handle 5 that force will overcome counterweight balancing and fluid 80 will be free to flow through the hydraulic system 15. Referring to FIGS. 1 and 2, a carriage support stop 145 may be mechanically affixed to the machine below the carriage 10 to prevent movement of the handle 5. The length or height of the carriage support stop 145 may be fixed in length to suit the exercise application. Alternatively, the height of the carriage support stop 145 may be adjustable as shown in FIGS. 1-2

Another embodiment of this invention offers a device for monitoring and displaying the force applied by the user over the ROM of the exercise without having to measure the position of the exercise handle 5. Typically, to graph force versus distance of travel, one measures the force and the position of a sensor within a system. Because the fluid flow rate within the system is substantially constant, the need to measure the position with a sensor is eliminated. A pressure transducer 130 may be introduced into the closed loop hydraulic system 15 to determine the force generated by the user. See FIG. 6-8. This transducer 130 measures the pressure of the fluid 80 before it enters the PTCFC valve 85 and the pressure exerted over the ROM is converted to a signal by a data acquisition device (DAQ) and sent to a computer. The DAQ and computer may be discrete devices or the DAQ may be integral to the display or touchscreen 125 as shown in FIGS. 1-2. A rotary encoder affixed to the speed adjustment mechanism 95 senses the position of that mechanism 90 and converts that position to an electrical signal representing the machine set speed. Through a series of calculations, a program within the computer converts machine set speed and pressure data into graphical representation of the workout and displays that information on the display or touch screen 125. The program may also calculate and display any number of statistical outputs based on force applied by the user over time such as the maximum and average force applied during the workout and data applying to each lift cycle. This allows the user to visualize physical performance over a series of repetitions and assess overall strength.

While the above description contains many specifics, these should be considered exemplifications of one or more embodiments rather than limitations on the scope of the invention. As previously discussed, many variations are possible and the scope of the invention should not be restricted by the examples illustrated herein.

The invention claimed is:

1. An exercise apparatus comprising:

a. a cabinet comprising at least one linear bearing rail;

b. a carriage having a mass and moveably seated within the linear bearing rail;

c. a counterweight having sufficient mass to offset the mass of the carriage;

d. a set of pulleys mechanically affixed to the cabinet;

e. a moveable sheave block;

f. a first wire rope connecting the counterweight to the carriage via one or more pulleys;

g. a second wire rope that is fixed to the cabinet at one end and connects the moveable sheave block to the counterweight via one or more pulleys;

h. a closed loop hydraulic system mechanically fastened to the moveable sheave block and comprising a piston moveably seated within a cylinder and in fluid communication with a pressure and temperature compensating flow control valve (PTCFC valve) wherein said PTCFC valve comprises a pressure compensating device, a temperature compensating device, a flow rate orifice needle, and a speed adjustment mechanism mechanically connected to said flow rate orifice needle, and wherein a reverse flow check device is integral to or in fluid communication with the PTCFC valve.

2. The apparatus of claim 1, wherein the carriage further comprises a handle that is pivotally mounted to the carriage in a manner that allows the handle to be positioned at different angles.

3. The apparatus of claim 1, further comprising a carriage support stop positioned in a location that prevents movement of the carriage.

4. The apparatus of claim 1, wherein the pulley sets are affixed to the cabinet in a mirror-image configuration.

5. The apparatus of claim 1, wherein a rotary encoder is installed on the speed adjustment mechanism, and, wherein, a touchscreen for controlling machine speed is in electronic communication with said rotary encoder.

6. The apparatus of claim 1, wherein the speed adjustment mechanism is connected to a motor and said motor is connected to a touch screen or control device such that the position of the speed adjustment mechanism is electronically controlled through a wireless or direct electrical connection with said motor.

7. The apparatus of claim 1, further comprising a display screen, a pressure transducer, and a data acquisition device in digital communication with a computer, wherein said pressure transducer transmits data pertaining to a force exerted on the carriage over time to the data acquisition device and computer, and wherein said computer calculates statistical information pertaining to the movement of the carriage over time, and wherein said statistical information is transmitted and displayed on said display screen as data or as a graphical representation of the data.

8. The apparatus of claim 1, wherein the closed loop hydraulic system further comprises a head tank for storing additional fluid and a valve to bleed air from the system.

* * * * *